US005938472A

United States Patent [19]

Yuen et al.

[11] Patent Number: 5,938,472

[45] Date of Patent: Aug. 17, 1999

[54] TAMPER INDICATING ARRANGEMENT

[75] Inventors: Ki Sheung Yuen, Brampton; Yiu Kong Wong, Scarborough, both of Canada

[73] Assignee: International Verifact Inc.

[21] Appl. No.: 09/071,113

[22] Filed: May 4, 1998

[51] Int. Cl.[6] ..... H01R 31/08

[52] U.S. Cl. ..... 439/509

[58] Field of Search ..... 439/76.1, 86, 488, 439/489, 509, 507

[56] References Cited

U.S. PATENT DOCUMENTS 5,788,516 3/1995 Uggmark ..... 439/86

*Primary Examiner*—Steven L. Stephan
*Assistant Examiner*—Javaid Nasri

[57] ABSTRACT

A tamper proof arrangement utilizes a multi-layered conductive/non-conductive electrical member to electrically connect electrical contact pairs located on a circuit board. The electrical member is supported by caps associated with a housing which contains the circuit board. Release of the end caps from the housing results in the electrical contact member breaking the connection between electrical contact pairs. This arrangement is particularly suited where a series of contact pairs are present and the electrical member closes each pair separately. In this way multi-pole switches are formed.

14 Claims, 3 Drawing Sheets

TAMPER INDICATING ARRANGEMENT

FIELD OF THE INVENTION

The present invention is directed to tamper indicating structures for use with electronic devices.

BACKGROUND OF THE INVENTION

There are many applications where it is desirable to deactivate, or effectively render an electrical device inoperative if unauthorized disassembly or tampering of the device has occurred. Basically, tamper indicating arrangements, or security switches, are used with circuit boards of electronic devices to prevent unauthorized tampering of the device.

There are many applications where unauthorized tampering with an electrical device can change the way the device operates and allow a criminal to commit a fraud. This recognized problem has been present for many years and electrical devices which include circuit boards, logic and memory, have been provided with tamper indicating switches. The opening of the housing of the device opens a switch and certain key information necessary for operation of the device is erased, rendering the device inoperable. One such arrangement uses mechanical switches which are spring loaded. The switches are attached to the circuit board and a releasable component of the case maintains the switch in the closed position. Disassembly of the housing effectively causes the switch to open. Although these prior art systems reduce the likelihood of fraud, the switch devices are somewhat bulky, add to the cost of the product and are not as fast reacting or as "tamper proof" as may be desired. The present invention provides a cost effective tamper indicating arrangement which is particularly suitable with devices containing circuit boards.

SUMMARY OF THE INVENTION

A tamper proof switch arrangement according to the present invention comprises a circuit board having at least two pairs of electrical contact points, a resilient segmented electrical contact member for connecting said contact points of said at least two pairs and a securing arrangement for locating the contact member relative to the circuit board and pressing the contact member against the circuit board. The resilient segmented electrical contact member comprises alternating conductive and non-conductive strips. Each pair of contact points is electrically connected by at least one conductive strip such that each pair of contact points has a different conductive strip forming the electrical connection therebetween. With this arrangement, the pairs of contact points are independent of each other.

According to a preferred embodiment of the invention, the two pairs of electrical contact points are located on one side of the circuit board. According to a further aspect of the invention, the alternating conductive and non-conductive strips are parallel strips and the contact points of a pair are aligned and parallel to the contact points of the at least other pair.

According to yet a further aspect of the invention, the pairs of electrical contact points and the resilient segmented electrical contact pad form a multiple switch.

According to yet a further aspect of the invention, the contact points form two separate switches closed by different conductive strips of the resilient segmented electrical contact pad.

According to yet a further aspect of the invention, the circuit board is maintained in a housing and the securing arrangement includes an endcap releasable secured in the housing. The endcap holds and supports the resilient segment and electrical contact pad. The endcap, upon release from the housing moves under a bias created by the resilient conductive electrical pad which bias causes the breaking of the electrical connection of the contact points via the electrical conductive pad.

According to yet a further aspect of the invention, the endcap is releasably secured to the housing by screws, and the resilient pad is supported in a cantilevered manner to one side of an end wall of the endcap.

According to yet a further aspect of the invention, the at least two pairs of the contact points include at least four pairs of contact points with two pairs of contact points located adjacent one edge of the circuit board and two pairs of contact points located adjacent a different edge of the circuit board and each of the two pairs of contact points have a separate resilient conductive pad.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
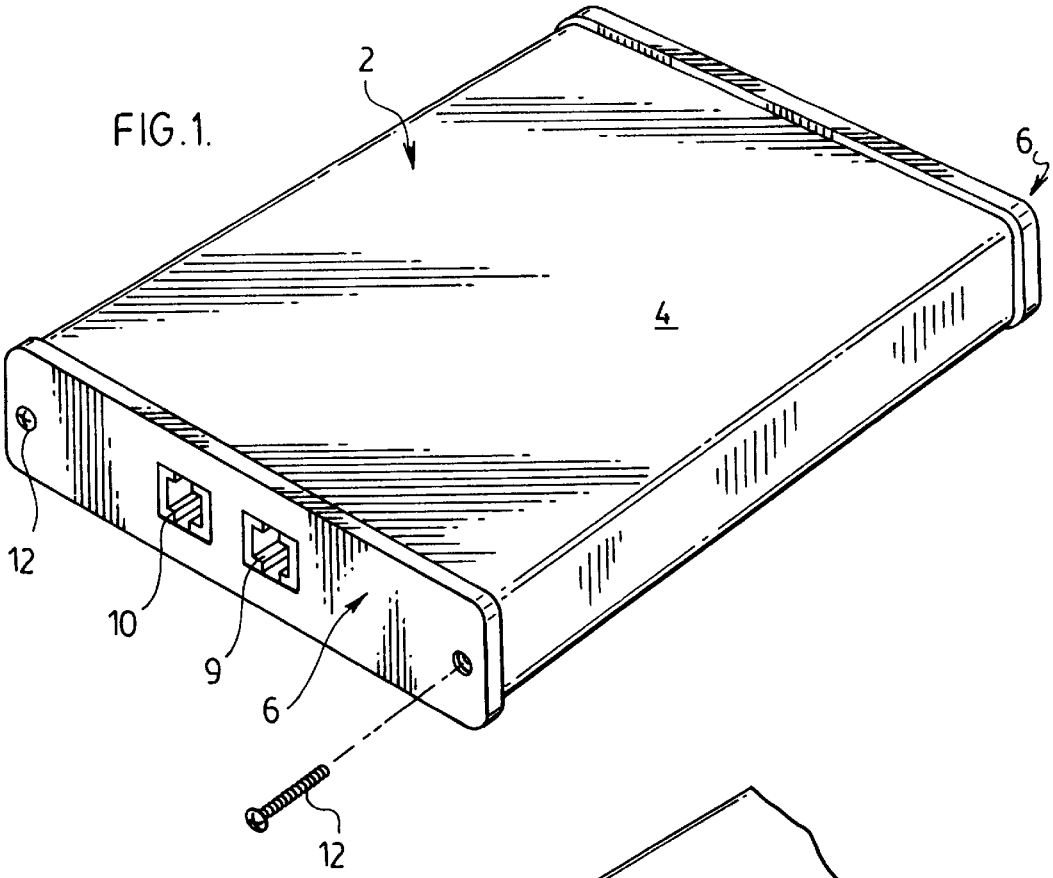
FIG. 1 is a perspective view of an electrical device closed at either end by two endcaps.

A communication device 2, as shown in FIG. 1, has an extruded housing 4 closed at either end by endcaps 6. Typically, the endcaps are of an injection molded plastic and the housing 4 can be of an extruded aluminum. The one piece extruded housing typically has channels positioned for appropriate fastening of the end caps.

Figure 2:
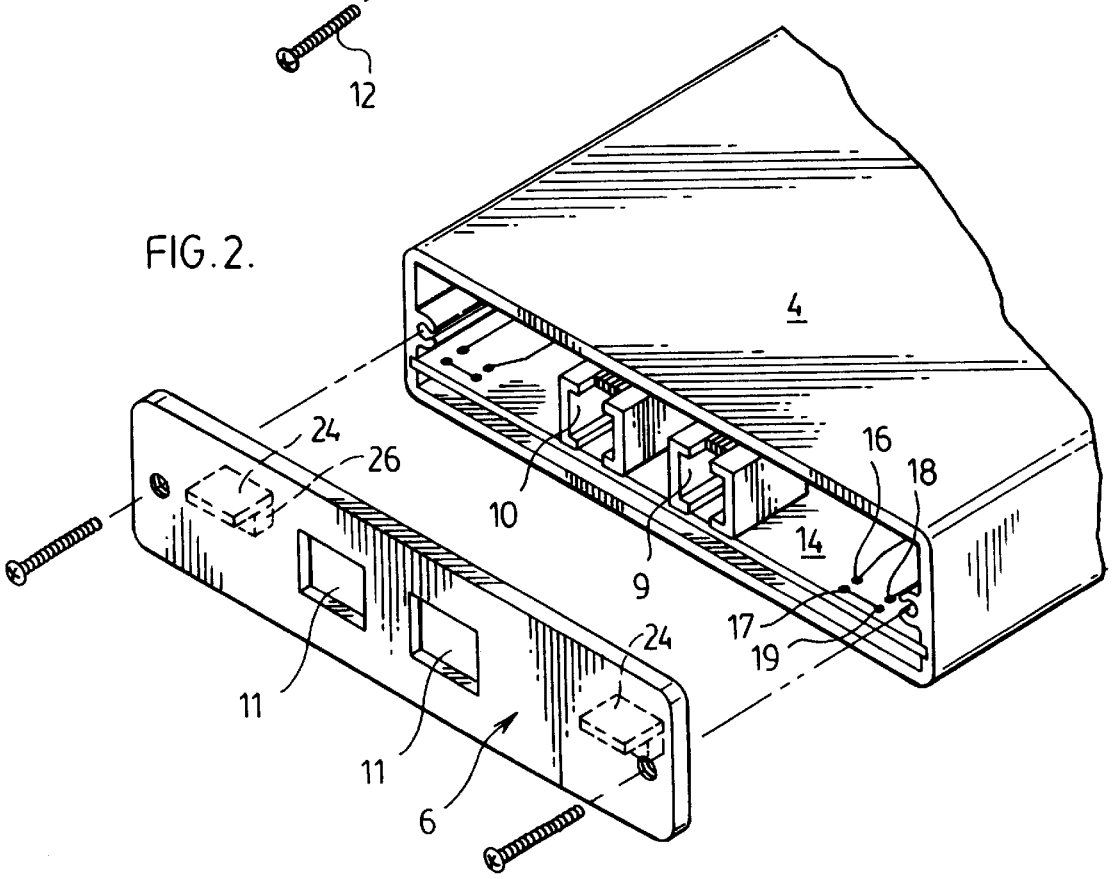
FIG. 2 is a partial exploded view of the device of FIG. 1 showing the cooperation of the endcap with a housed circuit board.

FIG. 2 shows the device with one endcap 6 partially removed, exposing the circuit board 14 located within the housing. This circuit board includes ports 9 and 10 which are accessible through gaps 11 provided in the endcap 6. Extending inwardly from the interior side of the endcap and to either side of the endcap is a holding arrangement 24 for receiving and retaining the resilient segmented electrical contact member 26.

The circuit board 14 is maintained in slots within the housing 4 and has electrical contact points 16, 17, 18 and 19 located to one side of the circuit board. These contacts points are generally aligned with the holder 24 and cooperate with the resilient segmented electrical contact member shown in FIGS. 3 and 4. Contact points 16 and 17 form one pair of contact points and contact points 18 and 19 form a second pair of contact points. Contact points 17 and 19 are shown connected, however, this need not be the case and these could be independent of one another. A similar pair of contact points are provided at the opposite side of the circuit board as shown in FIG. 2. The pairs of contact points are parallel to one another.

The circuit board 14 includes thereon volatile memory where certain critical information for carrying out the intended purpose of the device is maintained. This volatile memory can be associated with the contact points 16 through 19 and failure of the electrical connection between any of these contact pairs causes these critical parameters to be lost, rendering the device ineffective.

Figure 3:
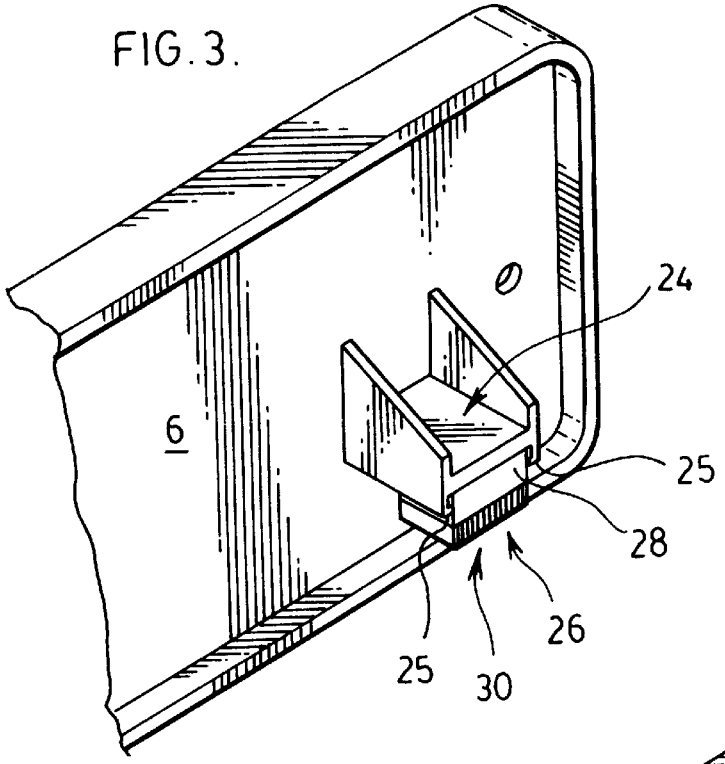
FIG. 3 is a partial perspective view of one end of the endcap.
Figure 4:
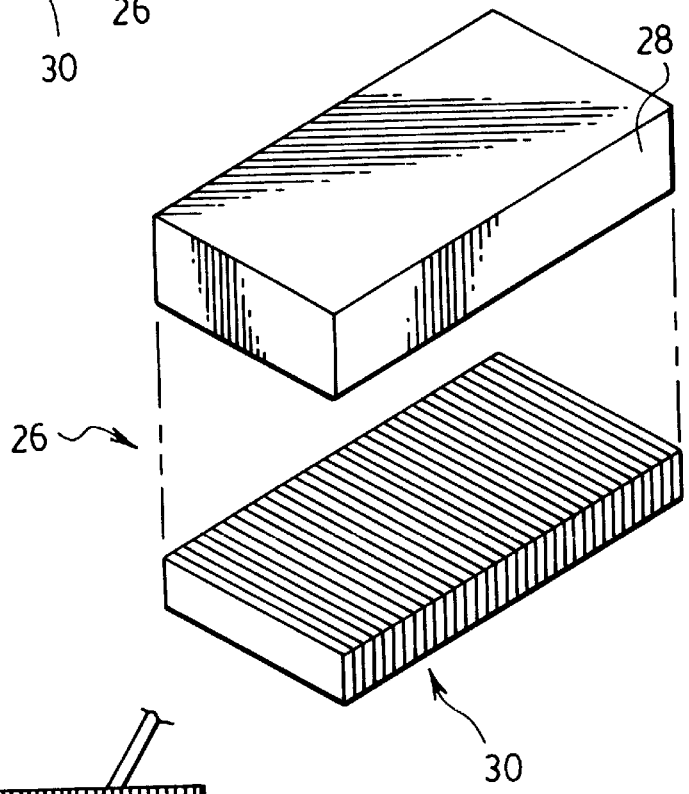
FIG. 4 is an exploded perspective view of the resilient segmented electrical contact member.
Figure 5:
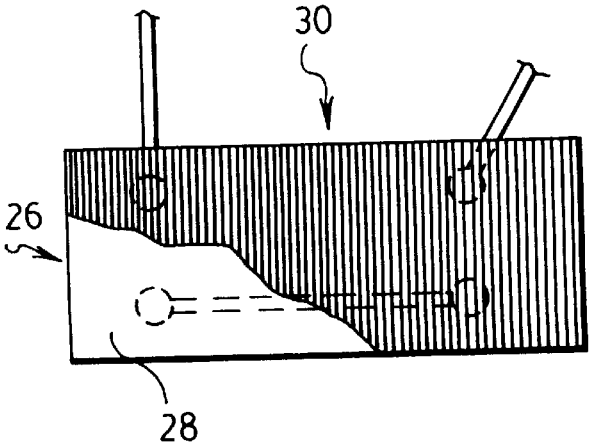
FIG. 5 is a partial cut-away top view showing how the resilient electrical segmented pad makes the connection with the two pairs of contact points.

Further details of the elements of the combination are shown in FIG. 3. As can be seen, the endcap 6 has a holding arrangement 24 for receiving and securing the resilient segmented electrical contact member 26. In the embodiment shown, the electrical contact member 26 has a resilient deformable non-conductive backing layer 28 which provides support for the series of alternating conductive, non-conductive layers generally shown as 30. Member 30 forms a zebra like pattern of alternating layers of conductive and non-conductive strips. These layers are made of an elastomeric material and preferably are alternating layers of conductive and non-conductive silicon rubber. This electrical connector is placed over and makes the electrical connection between the electrical contact pairs as shown in FIG. 5. The size of the electrical contact points 16, 17, 18 and 19 is large enough to ensure that at least one conductive layer effectively connects the contact points of a contact pair. This type of elastomeric connector typically requires a pressure to be applied to make sure there is effective contact between the contact point and a conductive layer of the segmented element. This downward pressure is achieved through the position of the holding arrangement 24 and the resiliency of the segmented electrical contact member 24 and the position of the circuit board 14 supported within the housing 4.

Figure 6:
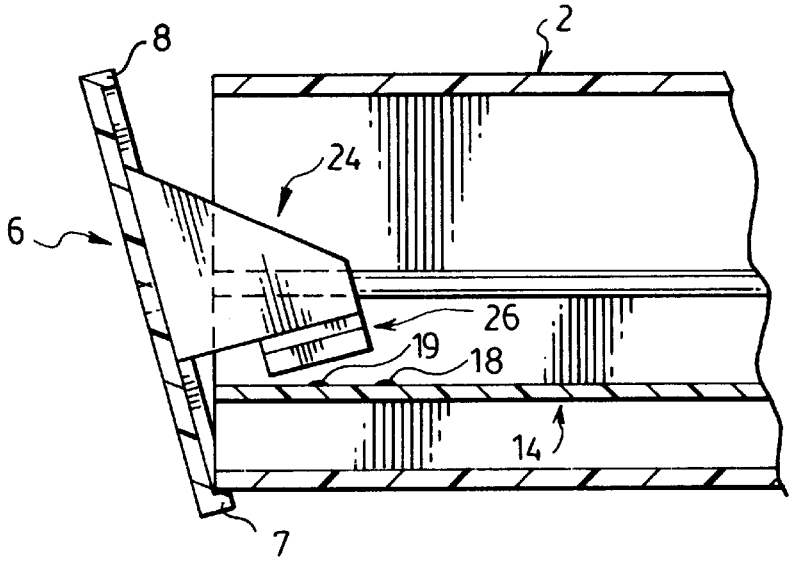
FIG. 6 is a partial side view showing an endcap being secured to the housing.
Figure 7:
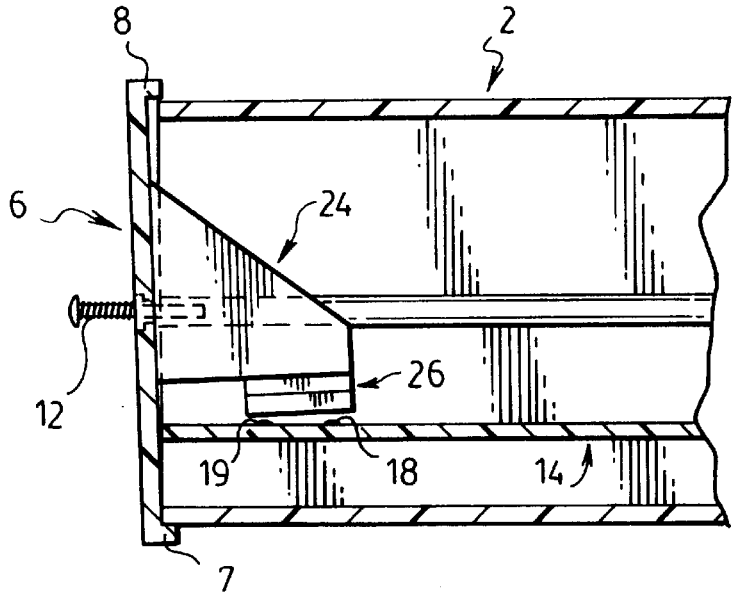
FIG. 7 shows the endcap about to be secured to the housing.
Figure 8:
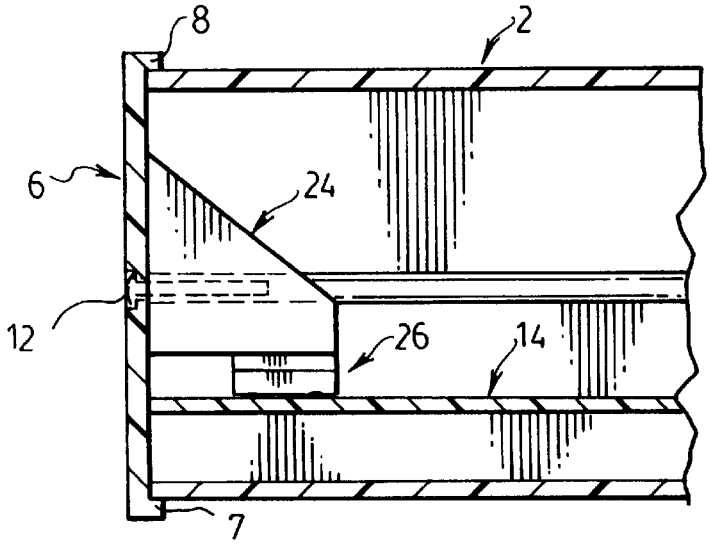
FIG. 8 shows the endcap secured to the housing with the resilient segmented electrical pad making contact with the circuit board.

Two electrical contact points, 18 and 19, are shown in FIG. 6 and the endcap 6 is about to be applied to the housing. The electrical contact member is supported in the holding arrangement 24 and, as shown in FIG. 3, inwardly directed fingers 25 grip the backing layer 28. The endcap 6 includes a lower flange 7 and a top flange 8. The lower flange 7 is placed against the base of the housing 4 and the endcap is rotated inwardly towards the final position of FIG. 8. As shown in FIG. 7, this movement brings alternating layers 30 of the electrical contact member 26 over the contact points 18 and 19, as well as contact points 16 and 17. Final securement by tightening of the screws 12, as shown in FIG. 8, will force the alternating layers 30 of electrical contact member 26 against the contact points 18 and 19 and cause resilient compression of the alternating layers 30 of the resilient segmented electrical contact member 26. This pressure forces some conductive layers to connect the various contact pairs, and thus, complete a circuit between the contact points of a contact pair. Any attempt to remove the endcap 6 will reduce the pressure and also cause some rotation of the endcap. This breaks the electrical connection between the contact points of a contact pair. Attempts to remove the endcap 6 will cause the electrical circuit between the contact points 18 and 19, or any of the other pairs of contact points, to be broken, which effectively opens the switch and this will trigger a circuit causing encryption keys and critical data in the system to be destroyed.

From the above, it is apparent that this structure makes an arrangement which is simple to assemble, and the arrangement is also fast to react if attempts are made to remove the endcaps. This device also allows for multi-pole switches formed by the series of paired contact points which can be placed along an edge of a circuit board and detection of a break in any of those circuits could be used to destroy critical data. The use of a simplified multi-pole switch makes it more difficult to overcome the security arrangement. These switches can be placed in series, or be independent switches or a series of grouped switches.

The switches have been located adjacent an edge of the circuit board for cooperating with the end caps but any location is possible. These switches can be used between any parts where separation of the parts should be detected. The system can also be used to present removal of a section of an integral part.

This arrangement can be used for any electronic device where unauthorized access to the electrical components should be detected and optionally some protective steps are taken when access is detected.

From the above, it is apparent that this arrangement forms a simple switch, or a series of multi-pole switches. It is simple in design, is easy to manufacture and utilizes existing printed circuit board technology without requiring hard wired electrical connections thereto. A closed switch is formed by the elastomeric connector which is pressed against the circuit board by the cooperating endcap and housing. It has also been found that this structure operates under a wide temperature range, has a wide humidity range, and is also chemically stable.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A tamper proof switch arrangement comprising a circuit board having at least two pairs of electrical contact points, a resilient segmented electrical contact member for connecting said contact points of said at least two pairs, and a securing arrangement for locating said contact member relative to said circuit board and pressing said contact member against said circuit board, said resilient segmented electrical contact member comprising alternating conductive and non-conductive strips, said resilient segmented electrical member having at least one conductive strip electrically connecting the electrical contact points of each pair and where each pair has a different conductive strip forming the connection.

2. A tamper proof switch arrangement as claimed in claim 1 wherein said two pairs of electrical contact points are located on one side of said circuit board.

3. A tamper proof switch arrangement as claimed in claim 1 or 2 wherein said alternating conductive and non-conductive strips are parallel strips and said contact points of a pair are aligned and parallel to the contact points of the at least other pair.

4. A tamper proof switch arrangement as claimed in claim 1 wherein said pairs of electrical contact points and said resilient segmented electrical contact member form a series of switches.

5. A tamper proof switch arrangement as claimed in claim 1 wherein said contact points form two separate switches closed by different conductive strips of said resilient segmented electrical contact member.

6. A tamper proof switch arrangement as claimed in claim 1 wherein said circuit board is maintained in a housing and said securing arrangement includes an closing member releasably secured in said housing which closing member holds and supports said resilient segmented electrical contact member, said closing member upon release from said housing moving under a bias provided by said resilient conductive electrical member and breaking electrical connection of said contact points via the electrical conductive member.

7. A tamper proof switch arrangement as claimed in claim 6 wherein said closing member is releasably secured to said housing by screws and said resilient segmented electrical contact member is supported in a cantilevered manner to one side of an end wall of said closing member.

8. A tamper proof switch arrangement as claimed in claim 7 wherein said at least two pairs of contact points includes at least four pairs of contact points with two pairs of contact points located adjacent one edge of said circuit board and two pairs of contact points located adjacent a different edge of said circuit board and each of said two pairs of contact points having a separate resilient conductive pad.

9. A tamper proof switch arrangement as claimed in claim 1 wherein said circuit board is supported in a housing having a first part and a separable part where said separable part cooperates with said first part to at least partially enclose said circuit board in said housing, and wherein, said securing arrangement is associated with said first part and said separable part and the connection between said contact points is broken when said first part and said separable part are separated.

10. A tamper proof switch as claimed in claim 6, 7 or 8, wherein said closing members are end caps.

11. A tamperproof switch arrangement as claimed in claim 1 wherein said circuit board is supported in a housing having an open port closed by a removable member releasably secured to said housing, said removable member when secured to said housing, forming part of said securing arrangement and pressing said contact member against said circuit board.

12. A tamperproof switch arrangement as claimed in claim 1 wherein said electrical contact points are connected to a volatile memory on said circuit board used to store data, said volatile memory losing any stored data if the electrical connection between said contact points fails.

13. A tamperproof switch arrangement as claimed in claim 12 which forms part of a communication device.

14. A tamperproof switch arrangement as claimed in claim 1 which forms part of a communication device.

* * * * *